United States Patent [19]

Hanson et al.

[11] 4,345,402

[45] Aug. 24, 1982

[54] TOY VEHICLE AND LAUNCHER

[75] Inventors: Steven P. Hanson, Rancho Palos Verdes; Robert E. Smathers, Los Angeles, both of Calif.; Howard J. Morrison, Deerfield, Ill.

[73] Assignee: Marvin Glass & Associates, Chicago, Ill.

[21] Appl. No.: 213,035

[22] Filed: Dec. 4, 1980

[51] Int. Cl.[3] ..... A63H 17/00

[52] U.S. Cl. ..... 46/206; 124/31; 46/1 K

[58] Field of Search ..... 46/201, 202, 206, 1 K, 46/74 B, 84; 273/86 D; 124/31

[56] References Cited

U.S. PATENT DOCUMENTS

| | | | |
|---|---|---|---|
| 1,356,324 | 10/1920 | Turner | 46/202 |
| 2,517,084 | 8/1950 | Carver | 46/206 |
| 2,563,969 | 8/1951 | Skinner | 124/31 |
| 3,835,583 | 9/1974 | Manning | 46/201 |
| 4,076,006 | 2/1978 | Breslow et al. | 46/74 B |

FOREIGN PATENT DOCUMENTS

| | | | |
|---|---|---|---|
| 1231843 | 5/1971 | United Kingdom | 46/206 |

*Primary Examiner*—F. Barry Shay

*Attorney, Agent, or Firm*—McDermott, Will & Emery

[57] ABSTRACT

A toy vehicle and a launcher includes an integral latch mechanism for holding the vehicle in a biased position and an actuating member for selectively releasing the latch. The vehicle includes an elongated tube of substantially dense, rigid material defining a frame to which wheels may be secured. The tube is encased within a soft, resilient, open cell foam material such as polyurethane foam which has been molded in the form of a vehicle body. A resilient, biasing member is mounted within the tube and is held in a compressed state by the latch. The launching member includes connection means to permit the connection of a series of launching members.

7 Claims, 4 Drawing Figures

TOY VEHICLE AND LAUNCHER

BACKGROUND OF THE INVENTION

1. Field of the Invention

This invention relates to a toy vehicle and particularly to a toy vehicle which not only may be used indoors without causing damage but is also safe for use by children.

2. Description of the Prior Art

Various toy vehicles adapted to be launched or propelled across a surface have been provided for use by both children and adults; however, most prior art toy vehicles of this type are made of hard durable material that cause damage to furniture if used indoors and may cause harm to a child if during play it is launched in the direction of the child.

Some prior art toy vehicles are made of soft material to avoid the potential for damage and harm; however, these toys suffer the disadvantage of being difficult to launch due to their pliable construction and are not capable of moving substantial distances since the wheels are often made of similar soft material and do not turn easily on an axle. Moreover, the soft material is lightweight such that a sufficient moment of inertia cannot be created upon launching of the vehicle reducing the distance traveled by these prior art toy vehicles and thereby reducing the pleasure derived therefrom by the child. An aerial toy vehicle which overcomes some of these problems is shown in U.S. Pat. No. 4,076,006 assigned to the assignee of the present invention.

SUMMARY OF THE INVENTION

An object of the present invention is to provide a new and improved toy vehicle that may be launched across a surface such as a floor indoors and without injury to children or furniture.

A further object of the present invention is to provide a new and improved toy vehicle constructed of soft porous material that includes a tubular rigid frame that allows a launching device to be connected thereto and also allows mounting of rigid wheels to the frame to provide faster and longer travel over a hard surface such as a floor or the like.

In the exemplary embodiment of the present invention a toy vehicle includes a wheeled vehicle and a launching device within which is mounted a latch. Mechanically coupled to the latch is an actuating device for actuating the latch to release the toy vehicle. The housing of the launching device includes structure for coupling a series of launching devices in tandem.

Other objects, features and advantages of the present invention will be apparent from the following detailed description taken in connection with the accompanying drawing.

DESCRIPTION OF THE PREFERRED EMBODIMENT

Figure 1:
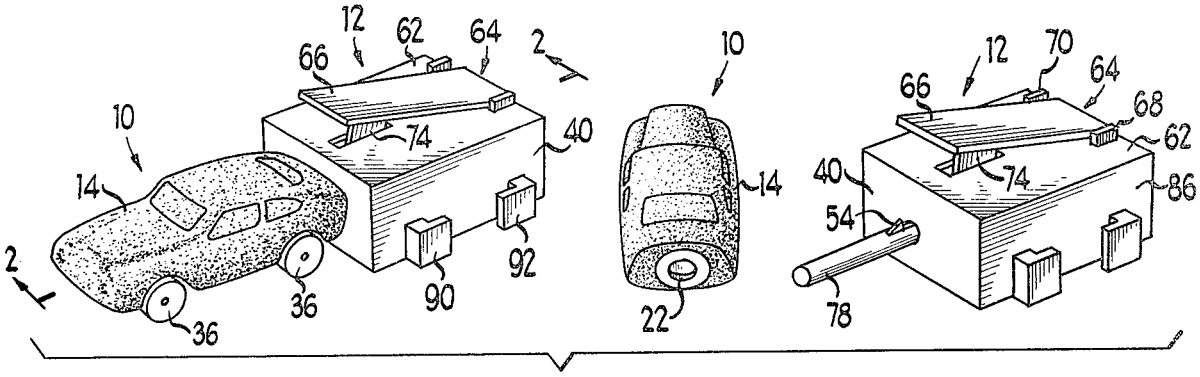
FIG. 1 includes two perspective views of a toy vehicle and launcher constructed in accordance with the principles of the present invention.

Referring to the drawings and initially to FIG. 1, a toy vehicle, generally designated by the reference numeral 10, is illustrated. It is the purpose of the toy vehicle 10 to be launched across a surface such as a floor or the like by a launching device, generally designated by the reference numeral 12.

It is preferred that the toy vehicle 10 may be used indoors without causing damage to furniture or similar items found in a home, and it is preferred that the vehicle 10 not harm a child if, for example, the toy vehicle 10 were launched at the face or body of a child. To accomplish these objectives, the toy vehicle 10 includes a body 14 fabricated primarily of a lightweight, soft flexible, spongy material such as polyurethane foam or the like. This material is lightweight and therefore once launched by the launching device 12, may not develop the desired inertia to travel a substantial distance thereby reducing the pleasure of the child using the toy vehicle 10. In addition, the soft material is pliable making it difficult to prevent deformation upon attachment of the toy vehicle 10 to the launching device 12. Similarly, a body 14 of soft pliable material makes it difficult to attach rigid wheels that are desired to increase the distance traveled by the vehicle over a hard surface.

Figure 2:
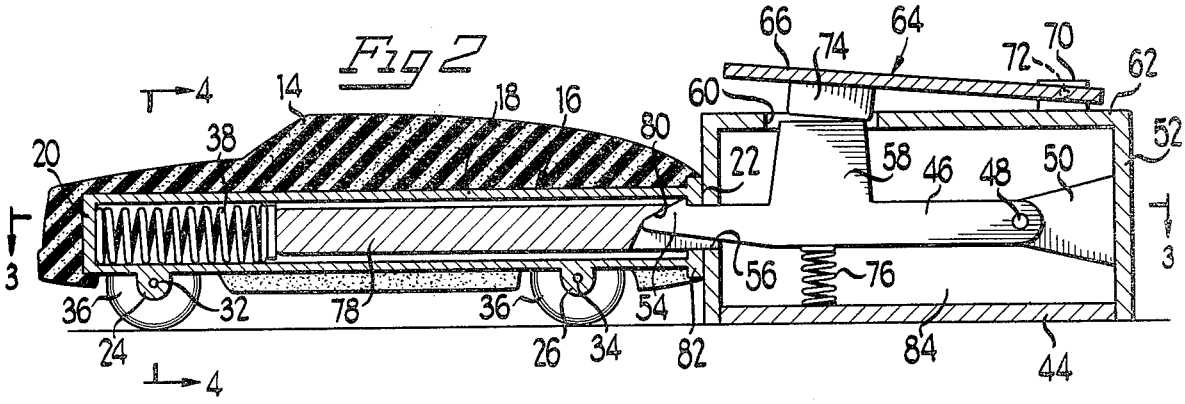
FIG. 2 is an enlarged vertical section taken generally along line 2—2 of FIG. 1.
Figure 3:
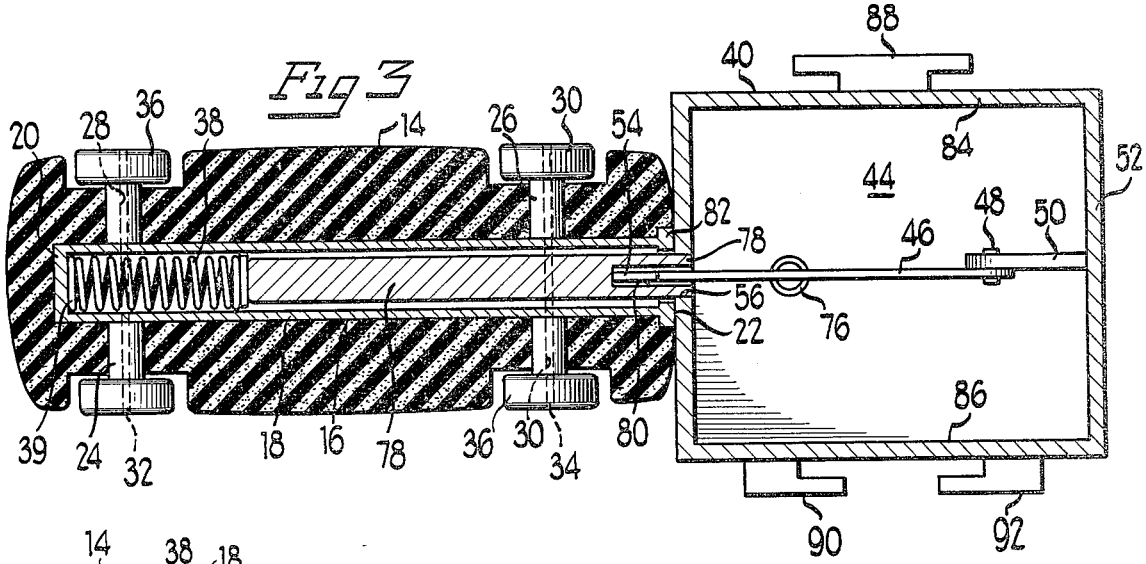
FIG. 3 is a horizontal section taken generally along line 3—3 of FIG. 2.
Figure 4:
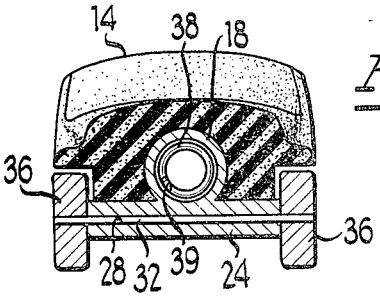
FIG. 4 is a vertical section taken generally along line 4—4 of FIG. 2.

The toy vehicle 10 includes a rigid, relatively dense tubular frame member, generally designated by the reference numeral 16 and best illustrated in FIGS. 2 and 3. The tubular frame member 16 primarily includes an elongated tube portion 18 that is closed at the front end 20 and opened at the rear end 22. The tube portion 18 includes a front 24 and rear rigid axles 26 extending perpendicularly thereto and preferably molded integrally therewith. Elongated holes 28 and 30 are fabricated within the axles 24 and 26, respectively. Shafts or axle rods 32 and 34 extend through the elongated holes 28 and 30 for mounting four rigid wheels 36. The spongy material, fabricated to form the body 14, is secured to the elongated tube 18. Consequently, the body 14 of the toy vehicle 10 is soft and pliable and thus will not damage furniture or harm a child playing with the toy vehicle 10; however, the frame 16 allows securement of rigid wheels 36 to the toy vehicle 10 and provides a mass within the body 14 to increase the inertia and insure that the vehicle will travel a greater distance over a surface once launched.

The toy vehicle 10 is launched by the energy developed by a biasing means and as from compressing a resilient spring 38 mounted at the closed end within the tube 18. The spring 38 includes an end 39 that is secured to the tube 18 in a manner to prevent it from falling out of the tube 18. To launch the vehicle 10, the spring 38 may be compressed and the energy released instantaneously to propel the toy vehicle 10 across a surface such as a floor or the like. It is to be understood that one skilled in the art would understand that the spring 38 need not be mounted within the tube 18 but rather could be positioned upon the launcher 12 as will be explained hereinafter.

The launching device 12 includes a housing 40 that in the preferred embodiment is rectangular in configuration and may be fabricated from a rigid plastic material. The bottom of the housing 40 is closed by a cover member 44 secured therein. The employment of the cover member 44 allows positioning of a latch member 46 within the housing 40. The latching member 46 is pivotally mounted by means such as a rivet 48 to an extension 50 defined within the housing 40 and secured to a back wall 52 thereof. The latch member 46 is an elongated lever with a latch or hook 54 defined on the end thereof extending forwardly outside of the housing 40 through an aperture or opening 56. The elongated latch 46 includes a vertical or perpendicular extension 58 that extends into or near an aperture or opening 60 defined in the top wall 62 of the housing 40.

An actuating member, generally designated by the reference numeral 64, is pivotally mounted on the top 62 of the housing 40. The actuating member includes an elongated planar element 66 that is connected to two support members 68 and 70 by a pin 72 allowing the planar element 66 to pivot about the horizontal axis of pin 72. The planar element 66 includes a wide, depending extension 74 that in the prelaunched position sits on the extension 58 of the elongated latch member 46.

The elongated lever member 46 is biased upwardly to engage the latch 54 against the upper surface of the opening 56 by a spring 76. The spring 76 also pushes the extension 58 of the latch member 46 against the extension 74 of the planar element 66. The latch 54 extends into a closed end shaft 78 secured within the aperture or opening 56 and extending outwardly through the front wall of the housing 40. A slot 80 is fabricated in the upper surface of the shaft 78 to allow the latch or hook 54 to extend therethrough.

The shaft 78 is inserted into the tube portion 18 to compress the spring 38 until the latch 54 snaps and locks behind a retaining flange 82 defined at the open end 22 of the tube portion 18. Once this occurs the toy vehicle 10 and launching device 12 are in the configuration illustrated in FIG. 2. The toy vehicle may then be launched by engagement of the planar member 66 moving it downwardly. This action moves the elongated latch 46 downward against the bias of the spring 76 until the latch 54 is moved out of engagement with the flange 82. The toy vehicle 10 is propelled by the energy from the expansion of the spring 38 across a surface such as a floor or the like and is directed during and after launch by the shaft 78.

An additional feature of the present invention is that several of the toy vehicles 10 may be aligned and released at the same time. To accomplish this, the launching device 12 includes a coupling assembly defined on the sides 84 and 86 of the housing 40. The coupling assembly includes a first T-shaped member 88 secured to the side 84 and first and second 90 and 92 L-shaped or flange members secured to the side 86. A series of launching members 12 may be coupled side by side in tandem by placement of the T-shaped member 88 into and between the flange members 90 and 92. Thereafter, upon all of the planar members 66 of each launching device 12 may be actuated to launch simultaneously a plurality of toy vehicles 10 across a surface such as a floor and the like.

What is claimed and sought to be secured by Letters Patent of the United States is:

1. A toy vehicle and launcher, in combination, comprising means for launching said vehicle, said launching means including a latch and a member for actuating said latch;

a biasing means for propelling said vehicle;

a relatively rigid vehicle frame including means for receiving said latch in a pre-launching mode and a plurality of wheels mounted on said frame, said latch receiving means comprising a hollow portion with a hook member in said hollow portion, a resilient member; and a vehicle body formed of a low density, soft, porous material secured to and enclosing said frame for defining the body of said vehicle.

2. The toy vehicle and launcher claimed in claim 1, wherein said launching means comprises a housing, including securing means for coupling a plurality of said housings in tandem.

3. The toy vehicle and launcher claimed in claim 1 wherein said actuating member is pivotally mounted on said launching means and movable upon engagement to engage and actuate said latch.

4. A toy vehicle and launcher, in combination, comprising:

a vehicle frame, said frame comprising an elongated relatively rigid member defining a receiving portion with a flange defined on a first end thereof, first and second axles transversely mounted on said member, first and second sets of wheels mounted on said first and second axles, respectively;

a vehicle body formed of low density, soft, porous material secured to and enclosing said member, said porous material formed in the shape of a vehicle;

a launcher including a housing defining an interior chamber, a first opening in said housing communicating with said chamber, a second opening in said housing communicating with said chamber, an elongated beam member mounted in said first opening and extending outwardly from said housing, a latch pivotally mounted in said housing, said latch including a hook, said hook positioned in said beam member, means for biasing said latch to a first position wherein said hook extends out of said beam member, and an abutment member pivotally mounted on said housing, said abutment member including a portion thereof extending into said second aperture and operatively engaging said latch.

5. The toy set forth in claim 4 further comprising a resilient element for propelling said vehicle positioned in said tube.

6. The toy set forth in claim 5 wherein said resilient element is secured to said frame.

7. The toy set forth in claim 4 further comprising means for coupling a plurality of said housings in series.

* * * * *